United States Patent [19]

Nukaya et al.

[11] Patent Number: 4,744,687

[45] Date of Patent: May 17, 1988

[54] PAPER FEED ROLLER DRIVE SYSTEM FOR A PRINTER

[75] Inventors: Yasuyuki Nukaya, Tokyo; Tomio Wakabayashi, Hatano; Iwao Mitsuki, Atsugi; Takeshi Motohashi, Yokohama, all of Japan

[73] Assignee: Ricoh Company, Ltd., Tokyo, Japan

[21] Appl. No.: 781,394

[22] Filed: Sep. 27, 1985

[30] Foreign Application Priority Data

| | | | |
|---|---|---|---|
| Sep. 29, 1984 | [JP] | Japan | 59-205248 |
| Dec. 18, 1984 | [JP] | Japan | 59-265173 |
| Dec. 25, 1984 | [JP] | Japan | 59-272050 |
| Dec. 25, 1984 | [JP] | Japan | 59-272051 |
| Dec. 31, 1984 | [JP] | Japan | 59-188131[U] |

[51] Int. Cl.[4] ..... B41J 11/58

[52] U.S. Cl. ..... 400/624; 400/625; 400/629; 192/71; 192/93 A; 271/9

[58] Field of Search ..... 400/320, 322, 624, 625, 400/629, 630, 703, 706, 707.1, 709; 271/9; 192/28, 71, 93 A, 93 C

[56] References Cited

U.S. PATENT DOCUMENTS

| | | | |
|---|---|---|---|
| 4,326,815 | 4/1982 | Kapp | 400/625 |
| 4,475,731 | 10/1984 | Wood | 400/629 |
| 4,570,919 | 2/1986 | Huang | 400/624 |
| 4,583,872 | 4/1986 | Chu et al. | 400/625 |

FOREIGN PATENT DOCUMENTS

| | | | |
|---|---|---|---|
| 2950707 | 9/1980 | Fed. Rep. of Germany | 400/629 |

*Primary Examiner*—David Wiecking

*Attorney, Agent, or Firm*—Cooper & Dunham

[57] ABSTRACT

A printing apparatus having a printing unit and a paper supply unit mounted thereon is provided with a control means which controls a carriage such that it occupies a position other than its home position when a front end of a paper passes through a guide member for guiding a printed paper. The apparatus can be provided with a movable paper guide which is movable between a use position and a wait position. A clutch mechanism is provided for transferring rotation from the platen to a feed roller associated with the paper supply unit.

2 Claims, 10 Drawing Sheets

PAPER FEED ROLLER DRIVE SYSTEM FOR A PRINTER

BACKGROUND OF THE INVENTION

The present invention relates to a printing apparatus having a printing unit and a paper sheet supply unit for supplying printing paper to the printing unit.

Such printing apparatus as serial printer, dot printer or thermal printer which has such printing unit and paper sheet supply unit has been known. The printing unit includes a carriage comprising a printing head for printing the paper sheet supported around a platen and a paper guide disposed in facing relation to the platen for guiding the paper and a driving unit for driving the carriage in a longitudinal direction of the platen. The paper sheet supply unit is mounted on the printing unit integrally or detachably.

In the printing apparatus of this type, it has been proposed to provide a guide member for paper discharge in the paper sheet supply unit so that a carrying direction of paper after having passed through the printing unit is defined precisely. With such guide means, it is possible to guide the paper after being printed in a predetermined direction, so that the paper sheet guiding becomes improved.

In a proposed construction, a paper supplied manually or automatically by the paper sheet supply unit is set in a predetermined position by sensing the paper to the guide member while a front edge of the paper is guided by the paper guide provided on the carriage. Since in the conventional printing apparatus, there is no printing operation during a supplying and setting of the paper, the carriage is returned to a home position in one end of the platen. Therefore, a portion of the front edge of the paper which passes through a region in the vicinity of the carriage is guided by the paper guide of the carriage and sent to the guide member. However, another portion of the front edge of the paper which is remote from the carriage cannot be fully guided by the paper guide and impinges with the guide member, resulting in a trouble. This is particularly true when the paper sheet is wide or thick.

On the other hand, a direction in which the front portion of the paper sheet after passed through a printing region moves depends upon the stiffness and size of the paper and an operating direction of a printing component of the printing head, e.g. a hammer, with respect to the paper, etc. In order to reliably guide the front edge portion of the paper regardless of the moving direction of the paper, it is necessary to enlarge the width of the guide member to thereby enlarge a paper receiving area thereof so that the front edge portion of the paper is always received by the guide member necessarily. However, when the guide member is enlarged, it becomes an obstacle in exchanging components of the printer which are mounted exchangeably. For example, a ribbon cartridge containing a printing ribbon is usually mounted on the printing head exchangeably. When the guide member is so enlarged, the ribbon cartridge is hardly detached or mounted without removing it or the automatic paper supply means.

SUMMARY OF THE INVENTION

The present invention is intended to remove the difficulties inherent to the conventional printing apparatus having a paper supply unit equipped with the discharge sheet guide member and an object of the present invention is to provide a printing apparatus having a control means for controlling a driving unit thereof such that, when a front end of a paper sheet arrives at the discharge paper guide member while the paper is being fed, a carriage occupies a position other than its home position.

Another object of the present invention is to provide a printing apparatus having a movable paper guide means which is movable between a use position in which the guide member guides the front end portion of the paper after being passed through a printing position and a waiting position other than the use position.

Other objects of the present invention will become apparent by reading the following description of preferred embodiments of the invention with reference to the accompanying drawings.

DESCRIPTION OF PREFERRED EMBODIMENTS

Figure 1:
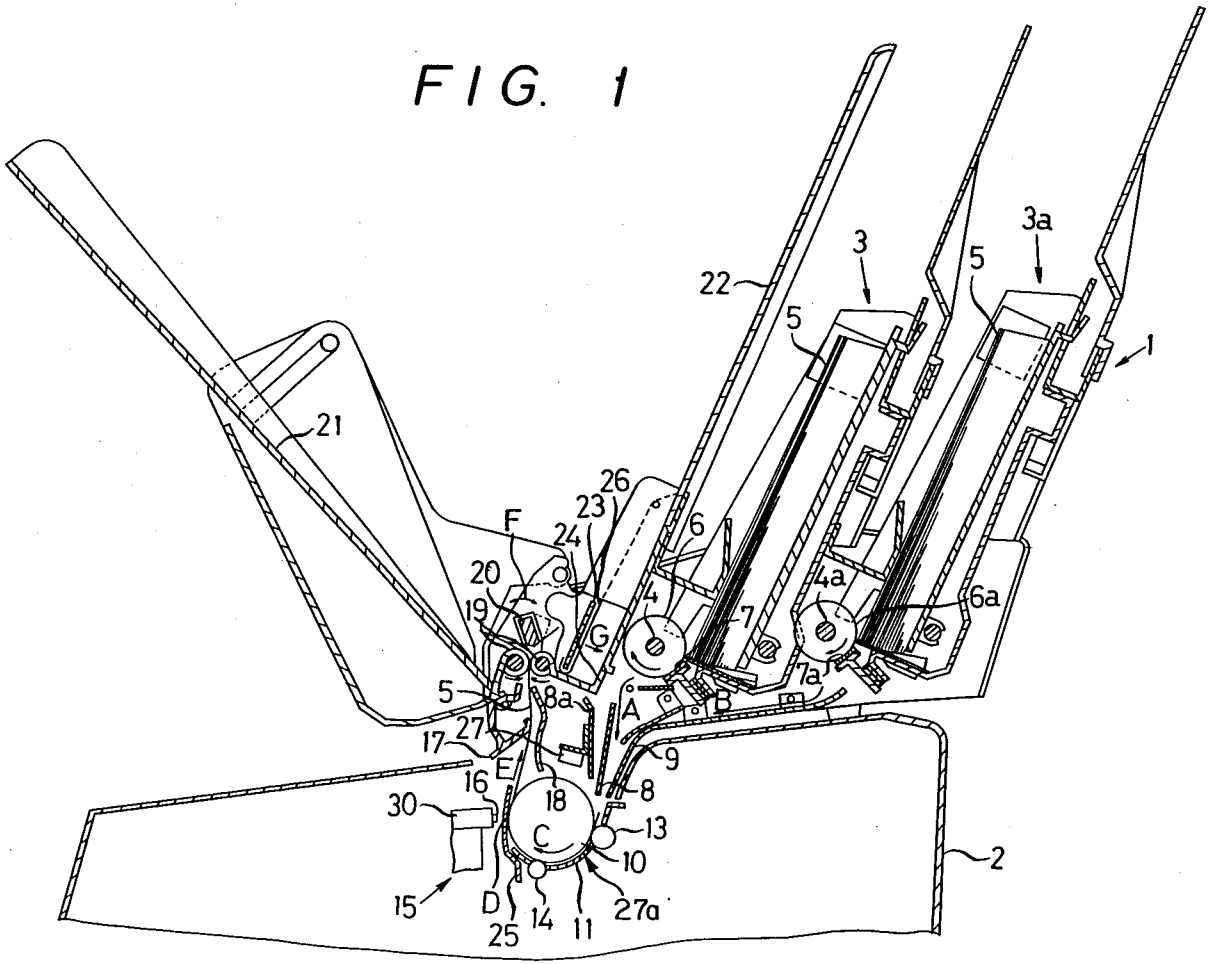
FIG. 1 is a cross section of an embodiment of a printing apparatus according to the present invention.

FIG. 1 shows an example of a printer having a printing unit 2 and a paper supply unit 1 mounted on the unit 2. The latter is shown with only portions to which the present invention is concerned.

The paper supply unit 1 includes a first and second paper supply portions 3, 3a and papers 5 mounted on the paper supply portions 3 and 3a are selectively fed out therefrom. The papers 5 fed out are separated during passing through between feed rollers 6 and 6a and friction pads 7 and 7a so that they are sent one by one without overlapping. Reference numerals 4 and 4a depict paper feed roller shafts, respectively. The paper sent from the first paper supply portion 3 is guided by guide plate 8 and 9 in a direction shown by an arrow A and the paper from the second paper supply portion 3a is guided by guide plate 9 in a direction shown by an arrow B, and then they are sent to a platen 10 of the printing unit 2.

Figure 2:
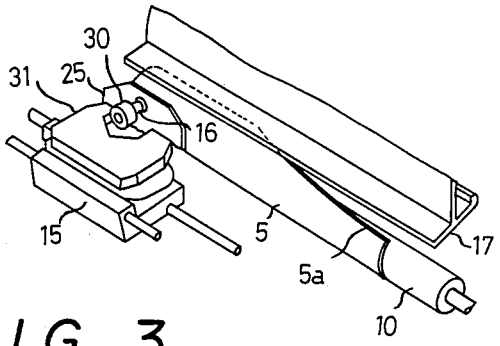
FIG. 2 is an oblique view of the printing apparatus showing a defect thereof which appears when a paper is set while the carriage is in its home position.
Figure 14:
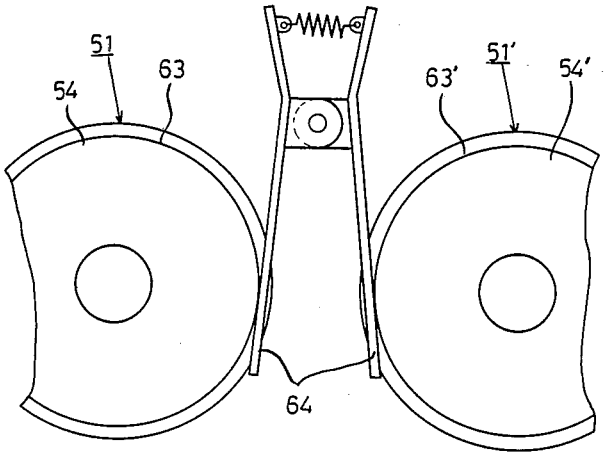
FIG. 14 is a view of an addition of a brake.

In the printing unit 2, the platen 10 is rotatably supported, around which a deflector 11 is provided. The deflector 11 is formed with holes in which rollers 13 and 14 are arranged such that they are in rotatable contact with the platen 10. Further, as shown in FIGS. 2 and 14, a carriage 15 is disposed in facing relation to the platen 10. The carriage 15 has a printing head 30, a ribbon cartridge 31 and a paper guide 25. The printing head 30 includes a printing type wheel not shown, a hammer 16 for hitting the wheel and a ribbon (not shown) and a hammer driving means.

When a front end of the paper from the paper supply portions 3 and 3a arrives at position in between the platen 10 and the feed roller 13, the platen 10 is rotating in an opposite direction to a usual direction C, i.e., counterclockwise. Therefore, the front end of the paper is stopped temporarily in that position in which a show of the paper is removed. Thereafter, the platen 10 starts to rotate in the usual direction C and the paper 5 is wound around the platen 10, while guided by the feed rollers 13 and 14 and the deflector 11, and carried along the arrow C.

In a printing operation, when a portion of the paper which is to be printed arrives at a printing position shown by a letter D in FIG. 1, the hammer 16 hits the paper 5 through the type and the ribbon to print. At this time, the carriage 15 is driven in a longitudinal direction of the platen 10 by the driving means 33 (FIG. 5) and the printing head 30 is also moved in the same direction while printing.

The paper passed through the printing portion D is guided by the paper guide 25 to the paper supply unit 1 as shown by an arrow E and then sent to a discharge paper roller pair 19 under a guidance of a discharge paper guide member 17 and a corresponding member 18. The roller pair 19 are rotating as shown by arrows and, when a changeover guide member 20 supported rotatably in an arrow F occupies the shown position, the paper is discharged to a first discharge paper tray 21 and, when the guide member 20 is switched to a position shown by a chain line, the paper is guided thereby and sent to a second discharge paper tray 22.

Figure 5:
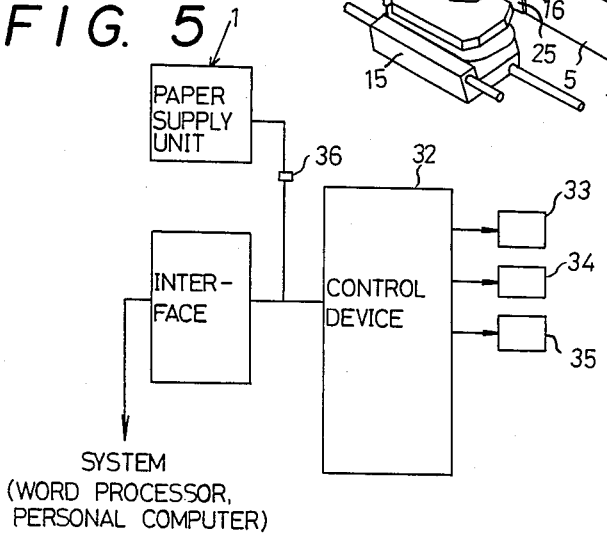
FIG. 5 is a block diagram of a control system of the present printing apparatus.

When the printing unit is connected to a system such as a word processor or a microcomputer, signals from the system is fed to the control device 32 of the printing unit 2 as shown in FIG. 5 and the driving means 33 of the carriage 15 is actuated under a control of the control device 32 to move the platen 10 in the longitudinal direction and perform the printing operation. A pulse motor, for example, provides a rotational driving force according to a shift control signal from the control device 32. A printing head driving means 34 rotates the type wheel according to a control signal from the control device 32 and to actuate the hammer 16. A paper feeding device 35 functions, according to a feeding control signal from the control device 32, to rotate the platen 10 to feed the paper steppingly.

The paper 5, after printed, is guided by the paper guide 25 as mentioned. The guide 25 also functions to prevent the paper portion in the printing region D from floating up from the platen 10. That is, if the paper floating from the platen 10 is directly sent to the roller pair 19, the paper will rise more than that shown in FIG. 1 and contact with the paper guide 25. Thus the guide may be deformed and the paper in the printing region may float up from the platen surface. When a printing is performed in such condition, a resultant print may be various in concentration and thus the quality of print is much degraded. With the discharge paper guide member 17, the paper portion passed through the platen 10 is slanted rightwardly in FIG. 1, temporarily, and the paper portion passing through the guide member 17 is slanted leftwardly to recover the attitude of the paper and then the paper is guided to the roller pair 19. Therefore, the floating up of the paper in the printing region is prevented and the paper is reliably guided to the roller pair 19.

In the paper supply unit 1 in FIG. 1 is constructed such that the paper can be supplied to the printing region manually. That is, the discharge paper tray 22 in FIG. 1 is provided with an auxiliary discharge paper plate 23 supported by a spring 26 swingably in an arrow G direction and a portion of the tray 22 positioned behind the plate 23 is formed with a slit 24 extending vertically to the drawing sheet.

In the usual paper discharge operation, the paper discharged onto the tray 22 rides on the plate 23. When the plate 23 is moved leftwardly in FIG. 1, the paper can be fed through the slit 24 manually. The paper manually fed passes through a path formed by the guide plates 8 and 8a to a path in between the platen 10 and the feed roller 13 where it is caught by the platen 10 manually rotated and sent to the printing region D where the front end thereof is fed to the guide member 17. The path from the slit 24 and the path from the paper supply portions 3 and 3a are joined at, for example, the position of the feed roller 13 in the embodiment in FIG. 1.

Figure 3:
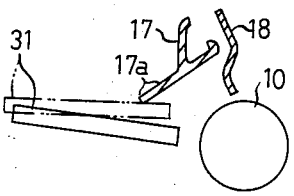
FIG. 3 is a cross section showing a defect when a top end of a discharge paper guide member is extended.

The above-mentioned construction and operation are well known. In this known apparatus, the printing operation is not performed until the paper supplied automatically or manually is sent to the printing region D and set in a predetermined position. Further, as mentioned previously, the carriage 15 is held stationary in its home position at one end of the platen 10 until the paper is set in the predetermined position as shown in FIG. 2. The front end of the paper sent to the printing unit in this state is guided by the paper guide 25. However, since the width of the guide 25 is smaller than that of the paper, a side portion 5a of the front end portion of the paper which is remote from the home position floats up from the platen 10 when the carriage 15 is in the home position and the paper width or thickness is large, as shown in FIG. 2, and impinges with the guide member 17. In order to prevent this difficulty from occurring, a front end of the guide member 17 may be extended to the paper guide side as shown by 17a in FIG. 3 so that the front end of the paper is reliably sent to the guide member 17. With such approach, however, the ribbon cartridge 31 which is exchanged by lifting it up as shown by a chain line in FIG. 3 may contact with the extended portion 17*a* of the guide member 17 during a ribbon exchange operation, causing the exchange to be impossible.

Figure 4:
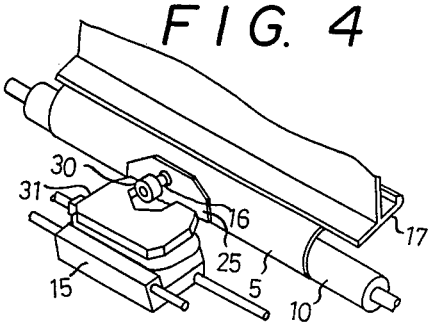
FIG. 4 is an oblique view of the present invention showing a fact that the front end of the paper does not impinge with the guide member when the carriage is moved from its home position.

According to the present invention, it is constructed such that the carriage occupies a position other than the home position, for example, a center region of the width of the paper 5 as shown in FIG. 4, when the front end of the paper fed to the printing region arrives at the discharge paper guide member. With such construction, the paper guide 25 of the carriage 15 can provide its guiding function over the full width of the paper 5 and, therefore, the front end of the paper is smoothly guided by the guide member 17 without impinging therewith even if the paper is wide or thick, and, thus, paper clogging is prevented effectively. The carriage 15 is returned to the home position by the driving device at any suitable instance in a time period from a time when the paper is set at the predetermined position to a time of commencement of printing operation.

The above-mentioned operation of the carriage 15 is performed by the driving unit 33 under a suitable control.

For the case of manual paper supply through the slit 24, a paper sensor 27 is provided for detecting the front end of the paper passing through the slit 24 and the feed roller 13 disposed at the juncture of the paths from the slit 24 and from the paper supply portions 3 and 3*a*, as shown in FIG. 1. The sensor 27 may be any of a reflection type photosensor and mechanical swithces and is fixedly mounted on the guide plate 8*a* by a bracket. When the front end of the manually supplied paper is detected by the sensor 27, an output of the sensor is supplied to the control device 32 disposed in the side of the printing unit 2 and the driving device 33 is actuated by an output signal from the control device 32 to move the carriage 15 from the home position by a predetermined distance (FIG. 4). After the front end of the paper enters into the guide member 17, the driving device 33 is actuated in response to a control signal from the control device 32 according to an instruction from the word processor or personal computer to return the carriage 15 to the home position. A reference numeral 36 in FIG. 5 depicts a connector for electrically connecting the paper supply unit 1 to the printing unit 2. When the printing unit 2 is to be used separately, the connector 36 is removed.

When the paper is supplied automatically from the paper supply portions 3 and 3*a*, the driving device 33 is actuated upon a control signal from the control device 32 according to an instruction from the system side such as the word processor or personal computer to move the carriage to the position shown in FIG. 4 and then return it to the home position. A paper sensor may be provided in the path from the paper supply portions 3 and 3*a* for detecting the front end of the paper to actuate the carriage 15. In such case, the sensor may be disposed at a downstream position from the juncture (feed roller 13) of the both paths so that the carriage 15 is actuated by a single sensor which is capable of detecting the paper from either the paper supply portion 3 or 3*a* or the slit 24.

The predetermined distance along which the carriage is moved from its home position is preferably determined such that the carriage 15 can reach the center of the paper width. However, it may be enough so long as the front end of the paper does not contact with the guide member 17.

The setting of the distance may be as follows:

(1) constant regardless of the paper size, (2) variable according to the paper width. A plurality of switches (not shown) corresponding to the paper sizes A4, A3, B4 and B5, for example, are provided in the paper supply unit 1. An operator selects one of the switches according to the paper size and supplies an output of the switch to the printing unit to determine the distance.

(3) variable according to a calculated value of the center position of the paper width. When the printing range of the paper can be defined by using a keyboard, the center position is calculated from a right hand margin information and a left-hand margin information registered in the printing apparatus.

In the setting (1), the control becomes very easy and in the setting (2) or (3) it may be possible to move the carriage to the center position reliably.

Figure 6:
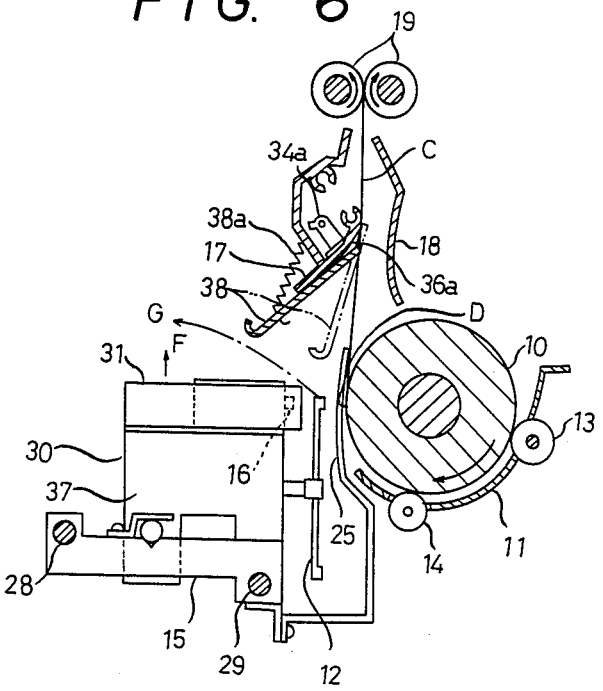
FIG. 6 is an enlarged view of the discharge paper guide member according to the present invention.

In the embodiment shown in FIG. 6, the printing head 30 supported by the carriage 15 is disposed in facing relation to the platen 10 such that, when the carriage 15 moves vertically to the drawing sheet while guided by guide rods 28 and 29, to printing head 30 is actuated in a parallel direction with the platen 10. The printing head 30 shown as an example comprises the printing type wheel 12 detachably supported by a frame 37 of the head 30, the hammer 16 for providing a hitting force to the types of the wheel 12 from the rear side thereof, and a motor (not shown) housed in the frame 37 to drive rotatably the wheel 12. The ribbon cartridge 31 is detachably mounted on the printing head 30 and the paper guide 25 is fixedly mounted on the cartridge 15.

The discharge paper guide member 17 shown in FIG. 6 is provided with a movable paper guide member 38. The guide member 38 does not contact with the printing head 30 and the ribbon cartridge 31 set in predetermined positions. However, it extends rightwardly and downwardly beyond the guide member 17 and makes a large angle with respect to the member 18 corresponding thereto. Therefore, it is possible to receive and guide the front end of the paper passed through the printing region D reliably regardless of the moving direction of the paper. In order to complete the function of the guide, the movable guide member 38 has a length larger than the width of the paper so that a paper portion which is not supported by the paper guide 25 is prevented from falling down.

The movable paper guide member 38 is supported so that is can move from the position shown by the solid line in which the front end of the paper is guided to the wait position shown by the chain line. In this case, the wait position is determined such that, when the ribbon cartridge 31 is removed by lifting it up in the direction of the arrow F or the printing head 30 is rotated in a direction G, these components are not interfered by the movable paper guide member 38. Therefore, the movable paper guide member 38 does not only function to guide the paper front end portion but also move to the wait position where it does not form an obstacle to movements of these components 12, 31 of the printer, without detaching the paper supply unit 1 from the printing unit 2.

Figure 7:
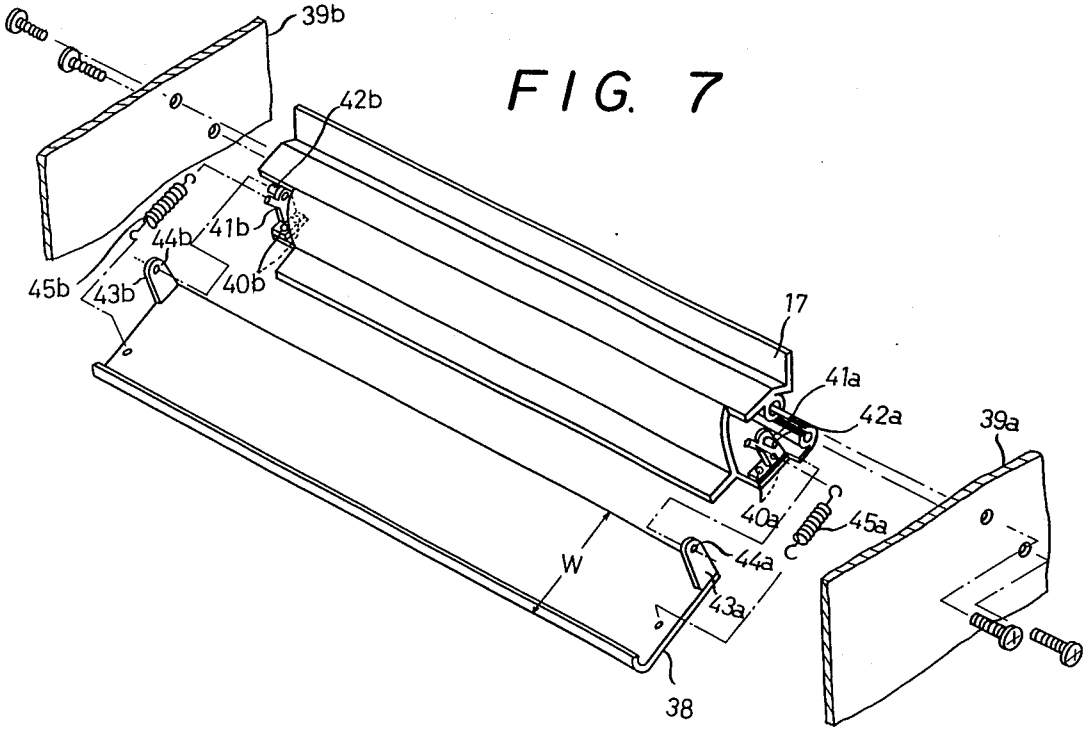
FIG. 7 shows the guide member in disassembled state.

A supporting mechanism of the movable guide member 38 for supporting the latter movably between the use position and the wait position may be arbitrary. An example of the supporting mechanism is shown in FIG. 7. In FIG. 7, the front side guide member 17 is rigidly supported by a pair of side plates 39*a* and 39*b* of the paper supply unit 1 rotatably supported by the rollers 19 and the rear side guide member 18 is similarly supported thereby. In the vicinity of respective end portions of the front side guide member 17, support brackets 41*a* and 41*b* are fixedly secured by screws 40*a* and 40*b*, respectively. The brackets 41*a* and 41*b* are formed with pins 42*a* and 42*b* on a common line, respectively. The pins 42*a* and 42*b* engage with holes 44*a* and 44*b* of ears 43*a* and 44*b* formed on the respective end portions of the movable guide member 38, respectively, so that the movable guide member 38 is rotatable about the pins aligned on the common line. Springs 45*a* and 45*b* are provided between the brackets 41*a* and 41*b* and the guide member 38 to bias the latter clockwise in FIG. 6 to thereby urge an outer face thereof to lower edge of the front guide member 17. That is, the movable guide member 38 is held in the use position by the actions of the springs 45*a* and 45*b*.

In order to move the movable guide member 38 to the wait position, it is enough to rotate it manually around the pins 42*a* and 42*b* counterclockwise against the springs 45*a* and 45*b*. When the guide member 38 reaches the wait position, the rear end thereof contacts with the front side guide member 17 and is held in that position. Therefore, the movable guide member 38 does not contact with the platen 10 and thus does not damage the latter. Other stopper member than the front side paper guide member 17 may be used for this purpose.

By releasing the movable paper guide member 38, the latter returns to the use position automatically by the springs 45*a* and 45*b*. Therefore, there is no case that the printing apparatus is actuated without returning the movable guide member 38 to the use position after the exchange of the ribbon cartridge 31 is completed.

As mentioned previously, the moving direction of the front end portion of the paper after passed through the printing region depends upon the paper stiffness, the operating direction of the hammer of the printing head and the shape and arrangement of the paper guide etc. and, due to the deviated wait position of the printing head and the narrow width of the paper guide, the end portion 5*a* (FIG. 2) of the paper which is opposite to the wait or home position of the head is considerably separated from the platen when the paper before printing is set in position. With the present movable paper guide member, it is possible to catch the paper in various moving direction.

Figure 8:
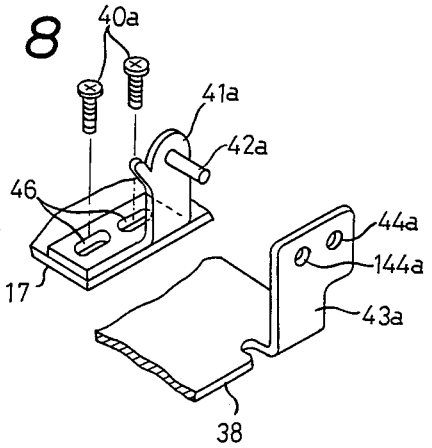
FIG. 8 is a partially disassembled guide member according to another embodiment of the present invention.

The paper supply unit 1 can be mounted on any printing unit of various types. Therefore, it is preferable to select the width W (FIG. 7), i.e., the amount of extension, of the movable guide member 38 large enough to make the guidance of the front end of the paper reliable. However, when the width is too large, an appearance of the apparatus may be degraded. When the paper can be guided by only the guide members 17 and 18 due to the quality and side of the paper, the movable guide member 38 can be omitted. According to the shown embodiment, the bracket 41*a* and 41*b* are detachably mounted to the front paper guide member 17 by the screws 40*a* and 40*b* so that the movable guide member 38 having width suitable to the type of the printing unit 2 is selectively mounted on the printing unit. However, it is troublesome to prepare the movable guide member 38 of various sizes. According to the present invention, the movable guide member 38 is formed in its ears 43*a* and 43*b* with a plurality of holes 44*a* and 144*a* one of which is selected according to the moving direction of the front end of the paper determined by the type of the printing unit 2 mounting the paper supply unit 1 and the pin 42*a* is inserted into the selected hole, so that it is possible to obtain desired amounts of extension with using the same movable guide member 38, as shown in FIG. 8. Alternatively, the bracket 41*a* is formed with long holes 46 or with a plurality of holes for the screws 40*a* so that the mounting position of the bracket 41*a* on the front guide member 17 can be selected suitably. This is the same for the bracket 41*b* and the ears 43*b*. By making the supporting position of the movable guide member 38 or the mounting position of the members for supporting the guide members 38 selectable, it can be applied to various printer types.

Although in the shown embodiment, the fixed front guide member is provided in addition to the movable guide member, it may be possible to omit the front guide member. That is, it is possible to support the conventional front guide member rotatably to use it as a movable guide member. Further, it may be possible to constitute the rear guide member as a movable guide member movable between the use position and the wait position. It is also possible to constitute the movable guide member which is not rotatable but movable lengthwise.

Figure 9:
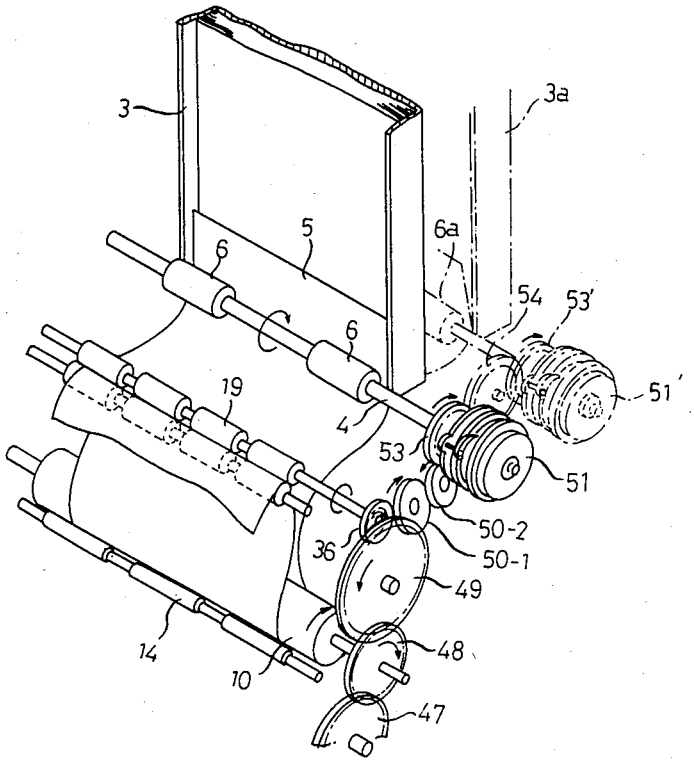
FIG. 9 is an oblique view showing a driving gear train for a platen and a paper feed roller of the paper supply unit.

A clutch mechanism for the rollers 6 and 6*a* of the paper supply unit 1 will be described with reference to FIG. 9. In FIG. 9, the platten 10 is driven by a platen gear 48 meshed with a driving gear 47 and the platen gear 48 meshes with a drive gear 53 of a drive disk 52 of a clutch mechanism 51 through intermediate gears 49, 50-1 and 50-2. The paper feed rollers 6 on a driven shaft 4 which is the paper feed roller shaft are arranged in facing relation to the paper cassette 3 containing the papers 5.

When a pair of paper cassettes are used, another clutch mechanism 51' having the same construction as that of the mechanism 51 is provided in facing relation to the cassette 3*a*. The mechanism 51' is driven by an intermediate gear 54 meshed with the gear 53 to drive the feed rollers 6*a*.

The gear 49 meshes with a gear 36 for rotating the rollers 19 for deriving the printed paper 5 from the platen 10. The intermediate gears 49, 50-1 and 50-2 are used to rotate the platen 10, the rollers 19 and the rollers 6 in the shown arrow directions, respectively. Therefore, the intermediate gear construction is not limited to that shown and any gear arrangement can be used so long as such rotations of the various elements are obtained. It should be noted that the arrows in FIG. 9 shows a forward rotation of the platen 10.

Figure 10:
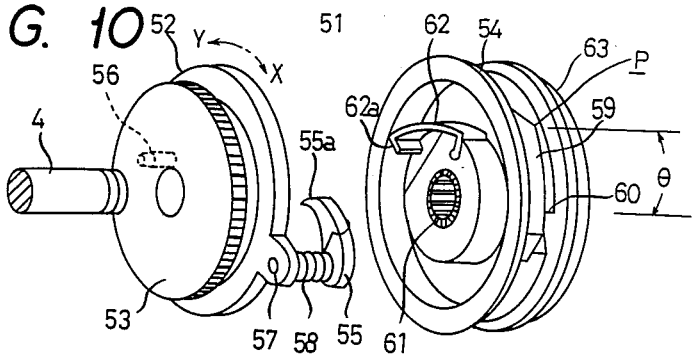
FIG. 10 is an oblique view showing a clutch mechanism, in disassembled state, of the present invention.

The clutch mechanism 51 is shown in FIG. 10 in more detail. In FIG. 10, the mechanism 51 is composed of the drive disk 52 freely rotatable on the drive shaft 4 and a clutch disk 54. The drive disk 52 is provided with the drive gear 53, a latch pawl 55 and a positioning pin 56.

The latch pawl 55 has an end portion 55*a* and is supported rotatably by a support pin 57 implanted on the drive disk 52 such that the end portion 55*a* rides on a slide surface 54*a* of the clutch disk 54 in pressure contact therewith with an aid of a spring 58 wound on the support pin 57. The latch pawl 55 is slanted such that the end portion 55*a* thereof directs toward a rotation center of the drive disk 52 by the action of the spring 58.

Figure 11:
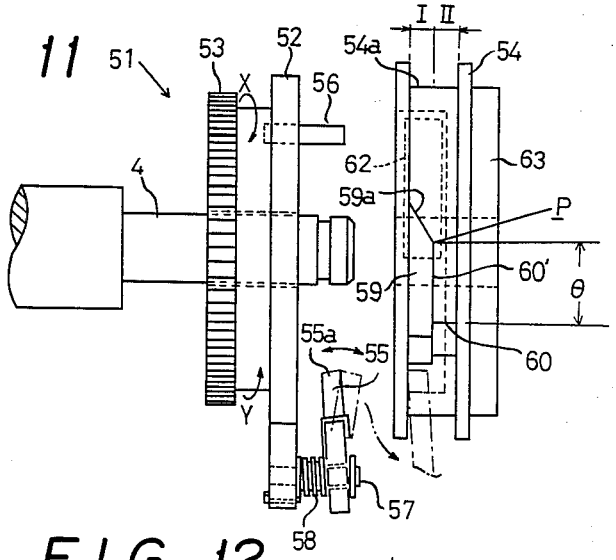
FIG. 11 is a plan view of the clutch mechanism.

In the embodiment shown in FIG. 11, the latch pawl 55 is provided and biased by the spring 58 such that the end portion 55*a* thereof is swingable and slides along a slide region I which s one of slide contact regions of the slide surface 54*a* of the clutch disk 54.

The region I is formed partially with a protruded portion 59 over which the pawl 55 passes through without contact of the end portion 55*a* therewith. The protruded portion 59 acts as a pawl switching portion and is formed with a slanted switching face 59*a* by which the end portion 55*a* is switched to a rotation transmitting region II of the slide surface when the drive disk is rotated in a direction shown by an arrow X.

Figure 12:
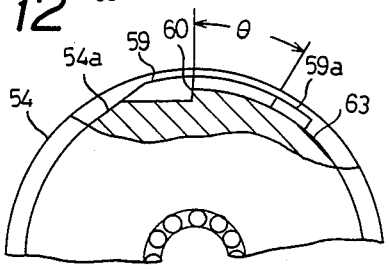
FIG. 12 is a cross sectional view showing a nail hole of a clutch disk.

A pawl recess 60 (FIG. 12) is formed in a portion of the region II in the side of the switching portion 59. The end portion 55*a* of the pawl 55 is trapped by the recess during its movement in the X direction after it is switched by the switching surface 59*a* to the region II. A rotation angle $\theta$ corresponding to a distance measured from an end of the switching surface 59*a* in the side of the region II, i.e., the switching point P, to the pawl recess 60 is selected as being larger than a rotation angle corresponding to a predetermined backline feed amount permissible during printing. A guide 60' is formed in a side surface of the switching portion 59, which extends from the point P to the recess 60. The recess 60 is shaped such that the latch pawl 55 having the end portion 55*a* trapped by the recess 60 due to the rotation mentioned above becomes in contact engagement with the clutch disk 54 when the drive disk 52 is reversely rotated in a direction shown by an arrow Y. The latch pawl 55 having the end portion 55*a* trapped by the recess 60 can escape from the recess 60 when the drive disk 52 continues to rotate in the direction X. In the latter state, the pawl 55 is switched by the spring 58 to the region I. Therefore, so long as the drive disk 52 continues to rotate in the direction X, the latch pawl 55 trapped by the recess 60 is returned to the region I after passed through the side of the pawl switching portion 59 to allow a free rotation of the drive disk 52.

The clutch disk 54 further mounts on a rotation center portion thereof with a one-way clutch 61 and is mounted on the driven shaft 4 through the one-way clutch 61. Therefore, when the clutch disk 54 is rotated in the direction X through the drive disk 52, the one-way clutch 61 is free with respect to the driven shaft 4 and when the clutch disk 54 and the drive disk 52, engaged with the clutch disk by the engagement of the latch pawl 55 and the recess 60, rotate in the direction Y, the rotation of the disk 54 is transmitted through the one-way clutch 61 to the driven shaft 4.

Inside of the clutch disk 54, a stopper 62 having one end free is provided correspondingly to the pin 56 of the drive disk 52. The stopper 62 functions to stop a movement of the pin 56 when the drive disk 52 is rotated in the direction X (FIG. 13), and when the drive disk 52 continues to rotate in the direction X with the pin 56 being stopped, the clutch disk 54 together with the drive disk 52 rotates in the same direction freely with respect to the driven shaft 4 through the engagement of the pin 56 and the stopper 62.

Therefore, during the free rotation of these disks engaged with each other by the engagement of the pin 56 and the stopper 62, a space angle $\theta$, between the latch pawl 55 and the recess 60 is maintained and thus the home position or wait position is constantly kept during rotations of the drive disk 52 is the direction X.

When the drive disk 52 is rotated in the direction Y, the pin 56 moves with respect to the stopper 62 while deforming the latter and the latch pawl 55 passes over the pawl switching portion 59, resulting in a free rotation of only the drive disk 52 with respect to the driven shaft 4. In this case, since the one-way clutch 61 is in an engaging state, the clutch disk 54 provides a load on the driven shaft 4 to rotate the latter and thus the disk 54 is held stationary. However, the clutch disk 54 is provided with a brake drum 63 and, as shown in FIG. 14, brake shoes 64 are applied therefor to stabilize the stopping condition of the clutch disk 54. Also in the shown embodiment, a pair of the brake shoes 64 are provided for a couple of the clutch mechanisms 51. The number of the shoes depends upon the number of the clutch mechanisms. Thus, the clutch 54 (or 54') is always prevented from rotating undesirably.

The drive disk 52 freely rotatably mounted on the driven shaft 4 and the clutch disk 54 are ganged by using an E ring (not shown).

In this clutch mechanism 51, the clutch disk 54 for driving the driven shaft 4 in one direction is not rotated by a mere rotation of the drive disk 52 in X or Y direction. When the drive disk 52 which is rotating in X direction due to the coupling mechanism is reversely rotated by an operating angle $\theta_2$ ($\theta_2=\theta_1+\theta'$, where $\theta'$ is an operating space angle, see FIG. 13) due to a reversal of the coupling mechanism, the end portion 55*a* of the latch pawl 55 rides on and passes over the pawl switching portion 59 of the clutch disk 54. Then, when the rotational direction of the drive disk 52 is reversed again and the disk 52 rotates in X direction by an operating space angle $\theta'$, the latch pawl 55 is retracted and the end portion 55*a* thereof becomes in contact with the switching surface 59*a* of the switching portion 59 and is guided to swing to the region II, and the latch pawl 55 is moved along a guide surface 60' by a distance corresponding to the angel $\theta$ and trapped by the recess 60. Therefore, in the driving side, when the drive disk 52 is reversed (Y direction) again correspondingly to the swing of the latch pawl 55, the latch pawl 55 can be engaged with the recess 60, so that the clutch disk 54 can rotate together with the drive disk 52 in Y direction. The rotation can be continuous and therefore, the driven shaft 4 can rotate in Y direction through the one-way clutch 61.

Figure 15:
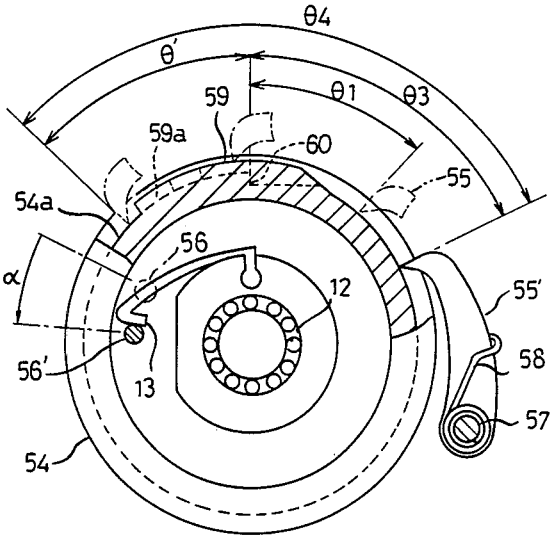
FIG. 15 shows a relation between the latch ball and the clutch disk when the carriage is out of its home position.

FIG. 15 shows another embodiment in which a plurality of clutch mechanisms 51 are used and in order to operate the respective clutch mechanisms independently, operating timings of the mechanisms are made different.

In FIG. 15, the position of the positioning pin 56 for setting the home position of the latch pawl 55 with respect to the recess 60 is set at a position 56' on a rotation locus of the pin 56 rearwardly thereof by an angle $\alpha$ so that the space angle which is the home position of the latch pawl 55' when the pin 56' and the stopper 62 are engaged with each other becomes $\theta_3$ with respect to the recess 60. That is, the selection of the clutch mechanism between 51 and 51' can be performed exactly by selecting operating rotation angles $\theta_2$ and $\theta_4$ of the latch pawls 55 and 55' engaged with the recess 60.

When one of the papers 5 is to be derived from the cassette 3 by rotation of the feed rollers 6, the platen 10 is rotated forwardly by an angle corresponding to 12 printing lines, for example. The rotation of the platen 10 is performed according to a program. With the rotation of the platen 10 by the 12 printing lines, the respective drive disks 52 are rotated forwardly in Y direction by the angle $\theta_2$ through the drive gears 53 and 53' of the clutch mechanisms 51 and 51', respectively. The forward rotation of the drive gear is started at the engaging position of the pin 56 and the stopper 62 during the free reverse rotation of the platen 10 with respect to the clutch disk 54, i.e., the set home position of the latch pawl 55 and the recess 60.

Figure 13:
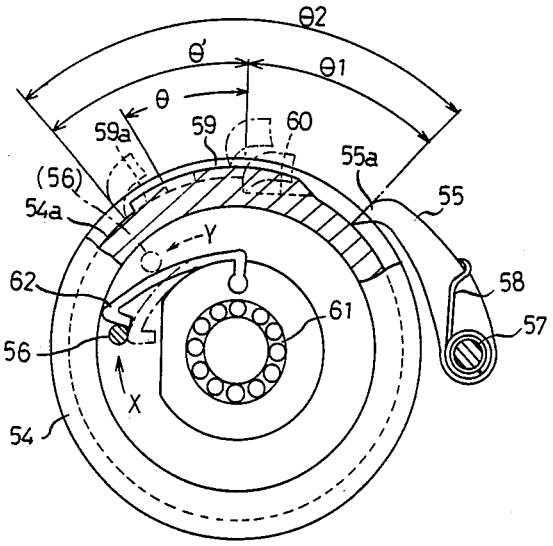
FIG. 13 illustrates a latch ball and the clutch disk for showing an engagement of a pin with a stopper.

Therefore, when the drive disk 52 rotates forwardly by an angle corresponding to 7 printing lines, the end portion of the latch pawl 55 moves to a position defined by $\theta_2=\theta_1+\theta'$ as shown in FIG. 13 and passes over the pawl switching portion 59. However, the other latch pawl 55' does not pass over the switching portion 59 because the space angle $\theta_3$ is large. Then, the platen 10 rotated by 12 printing lines is rotated in the reverse direction by 7 printing lines to reverse the top end 55*a* of the latch pawl 55 by the operating space angle $\theta'$. Thus, only the latch pawl 55 of the clutch mechanism 51 is trapped by the recess 60.

In this state, when the platen 10 is reversed to the forward direction, the latch pawl 55 is trapped by the recess 60 and the drive disk 52 and the clutch disk 54 are coupled. Thus, the driven shaft 4 is forwardly rotated (Y direction) by the forward rotation (Y direction) of the clutch mechanism 1. Therefore, the paper is supplied from the cassette 3 to the platten 10. The paper supply operation continues until the front end of the paper 5 reaches a paper supply opening to the platten 10 and is slightly taken into the platen. In this state, when the platen 10 is reversed, the front end of the paper is pushed back to the paper supply opening of the platen 10 and bent and the drive disk 52 is reversed to release the clutch coupling of the latch pawl 55 automatically. The feed rollers 6 rotate freely with respect to a paper feeding performed by the platen 10, regardless of the clutch mechanism 51. Thus the paper can be drawn to the printing region by rotating the platen 10 forwardly. With the clutch mechanism 51, the automatic feeding of the paper and the selection of papers to be supplied can be performed simply and exactly. When it is desired to select the clutch mechanism 51', it is enough to rotate the platen 10 forwardly by 14 printing lines and reversely by 7 printing lines according to the program.

When during printing on the paper sent to the printing region while the home position of the clutch is not maintained, i.e., the pawl end portion 55*a* is positioned just behind the switching portion 59 in the forward direction, a predetermined permissible amount of back line feed is performed, the end portion 55*a* is switched by the switching surface 59' to the region II. However, since the distance (peripheral length corresponding to the rotation angle $\theta$) from the switching point P to the recess 60 is larger than a length corresponding to the predetermined back line feed, there is no coupling through the end portio 55*a* and the recess 60.

Therefore, this construction satisfies conditions required for the clutch for use in the paper supply unit in which the paper is fed by forward rotation of the platen. Further it is possible to prevent an undesired coupling of clutch by the predetermined permissible back line feed during printing and hence undesired paper feeding.

Figure 16:
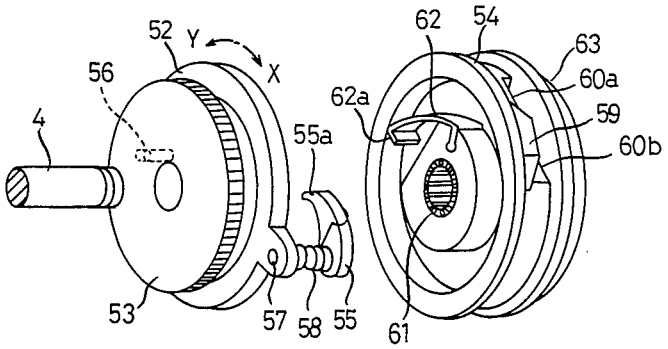
FIGS. 16 to 18 correspond to FIGS. 9 to 11, showing another embodiment of the clutch mechanism.
Figure 17:
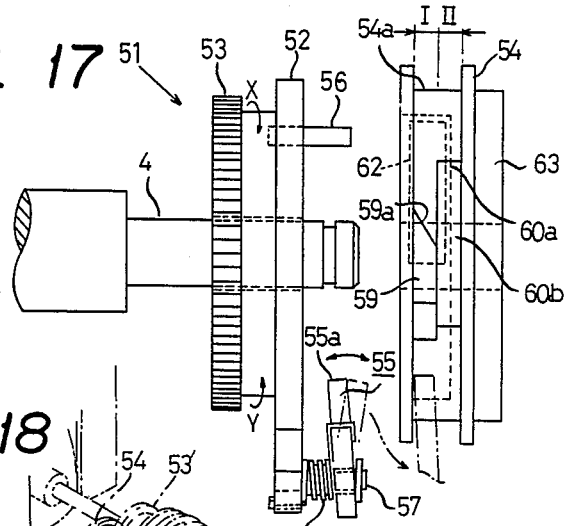

FIGS. 16 and 17 which correspond to FIGS. 10 and 11, respectively, show another embodiment of the clutch mechanism. Main differences of the embodiment in FIGS. 16 and 17 from that in FIG. 10 and 11 are that the position 60*a* of the recess is remote from the switching point of the pawl switching portion 59 by the length corresponding to the predetermined reverse rotation during printing, in Y direction, and that a groove 60*b* is provided for guiding the latch pawl 55 from the switching poit to the recess 60*a*.

Thus, the clutch is not actuated until the latch pawl 55 moving along the region I in Y direction is reversed to X direction by a reversal of the platen rotation, trapped by the groove 60*a* in the region II by the switching surface 59*a* of the switching portion 59 and then contacts with the recess 60*a* while moving in Y direction.

Therefore, when the pawl 55 is not in home position but in the region I, the pawl 55 slides along the region I and does not engage with the recess 60*a* even if the platen is rotated in reverse direction by a predetermined amount. When the platen is rotated forwardly, the pawl 55 is fallen in the groove 60*b* in the region II by the switching surface 59*a* dependent upon the amount of the forward rotation. However, since the distance between the switching surface 59*a* and the recess 60*a* is set as larger than the length corresponding to the predetermined permissible reverse rotation amount of the platen, there is no clutch coupling due to the engagement of the pawl and the recess even when the platen is reversely rotated by the permissible amount during printing. When the pawl 55 is in a portion of the region II beside the switching portion 59 during printing, there is not clutch coupling even if the platen is rotated reversely by an amount within the permissible amount since the distance to the recess 60*a* is larger than the length corresponding to the permissible range.

In a state where the pawl is in its home position, when the platen is rotated reversely and forwardly to make the clutch, the end portion 55*a* is switched to the region II by the switching portion 59 and thereafter, when the platen is rotated reversely by an amount equal to or larger than a predetermined amount by which the clutch does not engage, the end portion 55*a* is trapped by the recess 60*a* to make the clutch and the feed rollers are rotated in the paper feeding direction.

Figure 18:
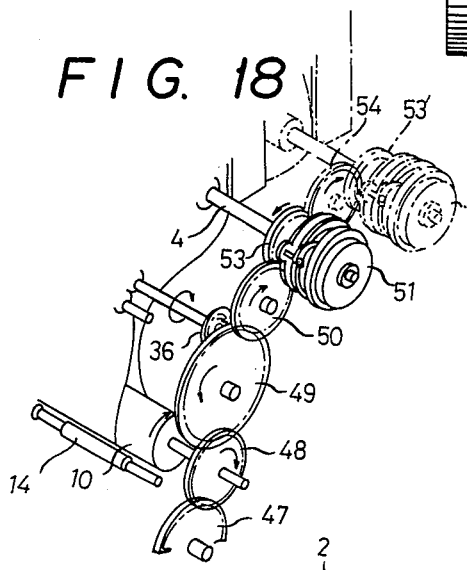

In the embodiment in FIGS. 16 and 17, a single intermediate gear 50 is used as shown in FIG. 18. That is, the clutch is actuated by rotating the platen in an opposite direction to the paper feeding direction by a predetermined amount and then rotating it in the forward direction by a predetermined amount.

As mentioned, according to this embodiment, it is possible to prevent an abnormal paper feeding due to an undesired coupling of the clutch caused by a reverse rotation of the platen of a predetermined amount during printing when the latch pawl is not in the home position.

Figure 19:
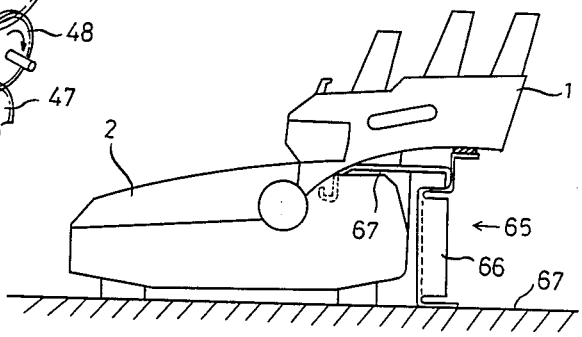
FIG. 19 is a side view showing a paper supply unit supporting base which is mounted on the printer and on which the paper supply unit is mounted.
Figure 20:
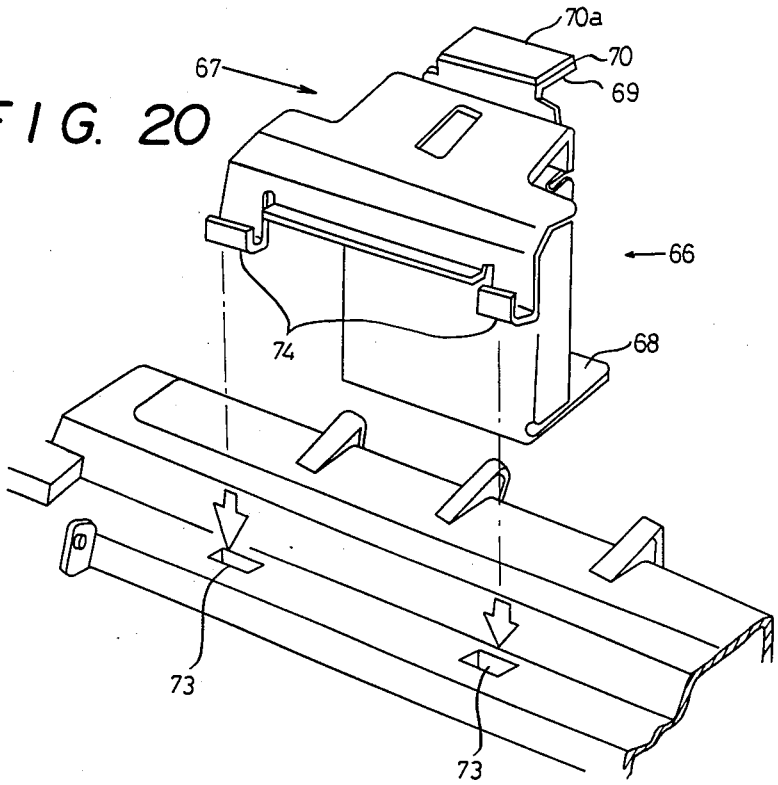
FIG. 20 is a front oblique view of the supporting base and a portion of an outer cover of the printer in disassembled state.
Figure 21:
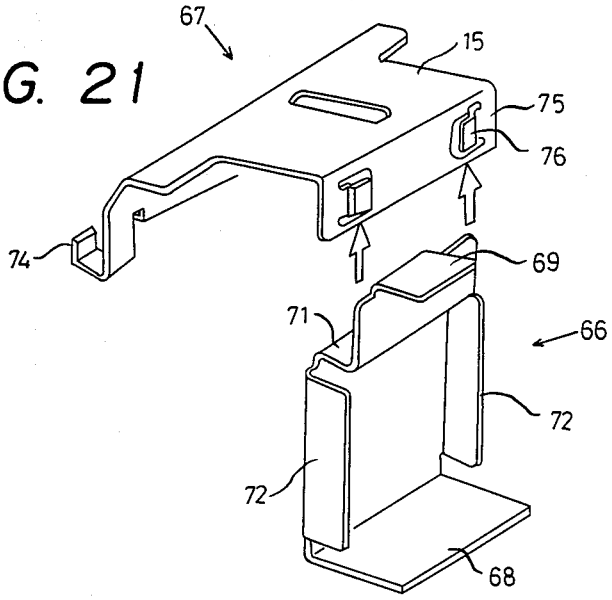
FIG. 21 is a rear oblique view of the supporting base, in disassembled state.

FIGS. 19 to 21 show the supporting plate of the paper supply unit, in which FIG. 19 shows the supporting plate 65 supporting a rear portion of the paper supply unit 1 mounted on the printing unit 2.

In FIGS. 20 and 21, the supporting plate 65 is composed of a base member 66 and a stay 67. The base member 66 has a lower flange 68 to be in contact with an upper surface of a desk and an upper flange 69 having a rubber plate 70 on which the rear portion of the paper supply unit 1 is disposed. A distance between a lower surface of the lower flange 68 and a upper surface 70*a* of the rubber plate 70 defines a height between a lower surface of the rear portion of the paper supply unit 1 and the desk surface 67. A vertical portion of the base member 66 is stepped to form a shoulder 71 at a position slightly lower than the upper end thereof and a pair of side flanges 72 are formed between the shoulder 71 and the lower flange 68.

The stay 67 has, in opposite ends of a front portion thereof, hooks 74 for positioning the base plate 65 by engaging with holes 73 formed in an upper surface of an outer cover of the printing unit 2 and, in a vertical portion 75 of a rear portion thereof, detaining portions 76 for engaging and holding side portions of the vertical portion of the member 66 above the shoulder 71 thereof such that a relative movement of the stay 67 to the base member 66 is prevented. These members and portions may be prepared by press and bending.

The base member 66 is joined to the stay 67 by inserting the side portions of the vertical portion of the member 66 into the detaining portions 76 until the shoulder 71 contacts with the detaining portions 76. Then, the hooks 74 of the stay 67 are engaged with the holes 73 of the printing unit. Thus, the base member 66 is coupled to the printing unit 2, with a lower surface of the lower flange 68 of the base member 66 being mated with the lower surface of a leg of the printing unit 2 and the upper surface 70*a* of the rubber plate 70 on the upper flange 69 being mated with the upper surface of the rear portion of the paper supply unit. Therefore, by positioning the front portion of the paper supply unit 1 in a predetermined position of such as the platen shaft of the printing unit and putting the rear portion on the rubber plate 70 disposed on the upper flange 69 of the base member 66, the paper supply unit 1 can be positioned in the predetermined position reliably stably without exerting any load on the outer cover of the printing unit.

When the paper supply unit 1 is to be detached, it is enough to disengage the coupling of the front portion engaged with the printing unit 2. Since the supporting member 65 is left attached to the printing unit 2, it is possible to put the paper supply unit on a safe place as it is.

Although the stay 67 and the base member 66 of the supporting member 65 are prepared separately for some reasons, it may be possible to form these members as a single member when the coupling portion in the side of the printing unit is provided in a rear surface of the outer cover of the printing unit.

As mentioned, the supporting member is very simple in construction and is capable of stably supporting the paper supply unit by merely mounting it on the rear portion of the outer cover of the printing unit. When the paper supply unit is to be removed, it can be done very simply since the supporting member is left attached to the printing unit, and the paper supply unit can be put on any place stably.

We claim:

1. A printing apparatus comprising a printing unit including a printing head for printing on a paper on a platen, a carriage disposed in facing relation to said platen and having a paper guide for guiding the paper and a driving means for driving said carriage longitudinally of said platen, a paper supply unit including a paper feeding portion for feeding the paper to a printing portion of said printing unit, a discharge paper guide member for guiding the paper passed through said printing portion and a control means for controlling said driving means such that, in feeding the paper, said carriage occupies a position other than its home position at least at a time when a front end of the paper starts to enter into said discharge paper guide member, said paper supply unit including an opening for feeding the paper to said printing portion manually and at least a paper supply portion for feeding the paper to said printing portion one by one, with a paper path from said opening and a paper path from said paper supply portion being joined at a joining point on said paths, and said control means including a paper sensor for detecting the front end of the paper passing through said joining point and for producing an output detection signal in response thereto, said driving means responsive to the output detection signal from said paper sensor for driving said carriage to said position other than said home position, wherein said platen has a drive shaft, and said paper supply unit includes paper feed rollers on a print feed roller shaft and a clutch for transmitting driving power to said paper feed rollers, said clutch being engaged by rotating said platen by a predetermined amount in a paper feeding direction and subsequently rotating a predetermined amount in an opposite direction to actuate said drive shaft of said platen to drive said feed rollers in synchronism with rotation of said platen in said paper feeding direction, said clutch being disengaged by rotating said platen in said opposite direction after the front end of the paper is slightly taken onto said platen, said clutch comprising a drive disk and a clutch disk supported rotatably by said paper feed roller shaft, said drive disk being provided with a drive gear, a latch pawl and a positioning pin, said clutch disk being provided with a stopper engageable with said positioning pin when said drive disk is rotated reversely, a one-way clutch disposed rotatably between a driven shaft and said clutch disc, a pawl switching portion for said latch pawl and a recess for selectively trapping said latch pawl, said latch pawl being biased toward said recess of said clutch disk and swingable to a direction of escaping from said recess and to a direction to a path including said recess when an end portion of said pawl passes through said pawl switching portion in a reverse direction, the distance between a switching point of said pawl switching portion and said recess being set larger than a pawl moving amount corresponding to a predetermined permissible reverse rotation amount of said platen during printing, and said apparatus further comprising a guide means for guiding said latch pawl from said switching point to said recess.

2. A printing apparatus comprising a printing unit including a printing head for printing on a paper on a platen, a carriage disposed in facing relation to said platen and having a paper guide for guiding the paper and a driving means for driving said carriage longitudinally of said platen, a paper supply unit including a paper feeding portion for feeding the paper to a printing portion of said printing unit, a discharge paper guide member for guiding the paper passed through said printing portion and a control means for controlling said driving means such that, in feeding the paper, said carriage occupies a position other than its home position at least at a time when a front end of the paper starts to enter into said discharge paper guide member, said paper supply unit including an opening for feeding the paper to said printing portion manually and at least a paper supply portion for feeding the paper to said printing portion one by one, with a paper path from said opening and a paper path from said paper supply portion being joined at a joining point on said paths, and said control means including a paper sensor for detecting the front end of the paper passing through said joining point and for producing an output detection signal in response thereto, said driving means responsive to the output detection signal from said paper sensor for driving said carriage to said position other than said home position, wherein said paper supply unit includes paper feed rollers on a paper feed roller shaft and a clutch for transmitting driving power to said paper feed rollers, said clutch being engaged by rotating said platen by a predetermined amount in a paper feeding direction and subsequently rotating a predetermined in an opposite direction to actuate a drive shaft of said platen to drive said feed rollers in synchronism with rotation of said platen in said paper feeding direction, said clutch being disengaged by rotating said platen in said opposite direction after the front end of the paper is slightly taken onto said platen, said clutch comprising a drive disk and a clutch disk supported rotatably by said paper feed roller shaft, said drive disk being provided with a drive gear, a latch pawl and a positioning pin, said clutch disk being provided with a stopper engageable with said positioning pin when said drive disk is rotated reversely, a one-way clutch disposed rotatably between a driven shaft and said clutch disc, a pawl switching portion for said latch pawl and a recess for selectively trapping said latch pawl, said latch pawl being biased toward said recess of said clutch disk and swingable to a direction of escaping from said recess and to a direction to a path including said recess when an end portion of said pawl passes through said pawl switching portion in a forward direction, a distance between a switching point of said pawl switching portion and said recess being set larger than a pawl moving amount corresponding to a predetermined permissible reverse rotation amount of said platen during printing, and said apparatus further comprising a guide means for guiding said latch pawl from said switching point to said recess.

* * * * *